United States Patent [19]

Sano et al.

[11] Patent Number: 4,791,094

[45] Date of Patent: Dec. 13, 1988

[54] RECORDING SHEET

[75] Inventors: Shojiro Sano; Keiso Saeki, both of Shizuoka, Japan

[73] Assignee: Fuji Photo Film Co., Ltd., Kanagawa, Japan

[21] Appl. No.: 936,406

[22] Filed: Dec. 1, 1986

[30] Foreign Application Priority Data

Nov. 29, 1985 [JP] Japan ..... 60-267522

[51] Int. Cl.[4] ..... B41M 5/16; B41M 5/18

[52] U.S. Cl. ..... 503/209; 427/151; 428/341; 428/342; 503/221

[58] Field of Search ..... 503/208, 209, 217, 218, 503/221, 215, 225; 427/150-152; 428/341, 342

[56] References Cited

U.S. PATENT DOCUMENTS

| | | | |
|---|---|---|---|
| 3,952,129 | 4/1976 | Matsukawa et al. . | |
| 4,390,616 | 6/1983 | Sato et al. . | |
| 4,425,161 | 1/1984 | Shibahashi et al. | 427/150 |
| 4,436,920 | 3/1984 | Sato et al. . | |

*Primary Examiner*—Bruce H. Hess

*Attorney, Agent, or Firm*—Sughrue, Mion, Zinn, Macpeak & Seas

[57] ABSTRACT

A recording sheet comprising microcapsules containing a substantially colorless electron donating dye, a diarylaminofluoran derivative, and a quinoline derivative represented by formula (I)

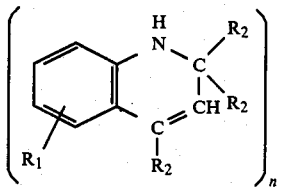

(I)

wherein $R_1$ represents a hydrogen atom, an alkoxy group having from 1 to 8 carbon atoms, an aryloxy group having from 6 to 18 carbon atoms or an aralkyloxy group having from 7 to 18 carbon atoms; $R_2$ represents a hydrogen atom or a methyl group; and n is an integer of 1 to 10. The recording sheet has a layer of microcapsules which does not turn blue on the surface thereof and does not experience any color staining where a surface of the coating is cut.

14 Claims, No Drawings

RECORDING SHEET

FIELD OF THE INVENTION

The present invention relates to a recording sheet, and more particularly to a recording sheet that utilizes the color-forming reaction between a substantially colorless electron donating dye and an electron accepting compound.

BACKGROUND OF THE INVENTION

Recording sheets that utilize the color-forming reaction between substantially colorless electron donating dyes (hereinafter referred to as color formers) and electron accepting compounds which develop color upon contact with the color formers (the second group of compounds are hereinafter referred to as developers) include pressure-sensitive copy sheet, heat-sensitive recording sheet, and electrosensitive recording sheet and detailed description thereof are found, e.g., in U.S. Pat. Nos. 2,712,507, 2,730,456, 2,730,457, 3,418,250, 3,432,327, 3,981,821, 3,993,831, 3,996,156, 3,996,405 and 4,000,087.

These recording sheets are available in various forms: in one form, a top sheet comprising a support which is coated with a microcapsule layer containing microencapsulated oil droplets of a color former in an appropriate solvent is placed over a receiving sheet comprising a support which is coated with a layer containing a developer; in a modified case, an intermediate sheet comprises a support one surface of which is coated with a microcapsule layer and the other surface of which is coated with a developer layer; in another form, both the microencapsulated color former and the developer are incorporated in the same surface of a support; in still another form, only one of the microencapsulated color former and the developer is incorporated within the support while the other component is coated on the support.

It has already been proposed that diarylaminofluoran derivatives be used in these recording sheets as color formers that are capable of providing color images having extremely high resistance to light as described in U.S. Pat. Nos. 4,436,920 and 4,390,616. However, the recording sheets containing these diarylaminofluoran derivatives in microcapsules have proved to suffer from the disadvantage that the microcapsule-coated surface turns blue or that any surface of the coating which may be cut is liable to color staining.

SUMMARY OF THE INVENTION

One object, therefore, of the present invention is to provide a recording sheet that comprises a layer of microcapsules containing a diarylaminofluoran derivative as a color former and which does not turn blue on the microcapsule-coated surface and does not experience any color staining where a surface of the coating is cut.

The above-described object of the present invention has now been attained by a recording sheet which employs microcapsules containing a diarylaminofluoran derivative as a substantially colorless electron donating dye and a quinoline derivative represented by formula (I)

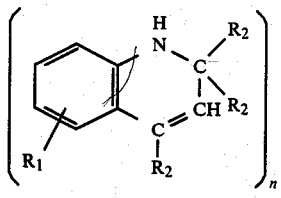

(I)

wherein $R_1$ represents hydrogen atom, an alkoxy group having from 1 to 8 carbon atoms, an aryloxy group having from 6 to 18 carbon atoms or an aralkyloxy group having from 7 to 18 carbon atoms; $R_2$ represents a hydrogen atom or a methyl group; and n is an integer of 1 to 10.

DETAILED DESCRIPTION OF THE INVENTION

Preferable examples of $R_1$ in formula (I) are a hydrogen atom, a methoxy group, an ethoxy group and a benzyloxy group. Specific examples of the compound of formula (I) are listed below:

(1) 2,2,4-trimethyl-1,2-dihydroquinoline;
(2) 6-ethoxy-2,2,4-trimethyl-1,2-dihydroquinoline;
(3) 6-methoxy-2,2,4-trimethyl-1,2-dihydroquinoline;
(4) 6-octoxy-2,2,4-trimethyl-1,2-dihydroquinoline;
(5) 6-phenoxy-2,2,4-trimethyl-1,2-dihydroquinoline;
(6) 6-benzyloxy-2,2,4-trimethyl-1,2-dihydroquinoline;
(7) 7-ethoxy-2,2,4-trimethyl-1,2-dihydroquinoline; and
(8) 1,2-dihydroquinoline.

Polymers of these compounds can also be used.

The quinoline derivatives of formula (I) are preferably used in amounts ranging from 5 to 200%, and more preferably from 10 to 100%, of the weight of the diarylaminofluoran derivative.

Examples of the diarylaminofluoran derivatives which are preferably used as color formers in the present invention are represented by formula (II)

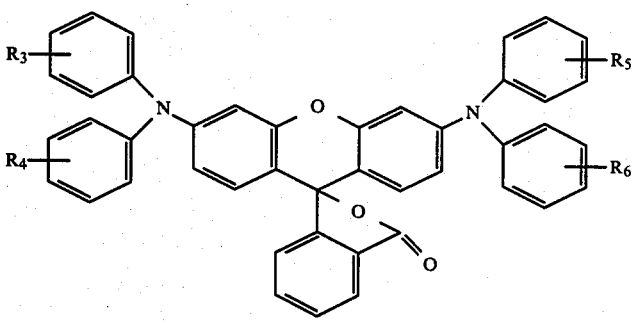

(II)

wherein $R_3$, $R_4$, $R_5$ and $R_6$ each represents a hydrogen atom, an alkyl group, an alkoxy group, or a halogen atom.

Specific examples of the compounds represented by formula (II) are set forth below:

(1) 3,6-bis-diphenylaminofluoran;
(2) 3-diphenylamino-6-ditolylaminofluoran;
(3) 3,6-bis(N-phenyl-N-tolyl)aminofluoran;
(4) 3,6-bis(N-phenyl-N-anisyl)aminofluoran;
(5) 3,6-bis(N-p-chlorophenyl-N-phenyl)aminofluoran; and
(6) 3-diphenylamino-6-(N-phenyl-N-isopropylphenyl-)aminofluoran.

These compounds may be used alone or in combinations thereof. The diarylaminofluoran derivatives are preferably used in a coating amount of 0.04 to 0.2 g/m$^2$.

The diarylaminofluoran derivatives of formula (II) shown above may be used in combination with other color formers, such as triarylmethane-based compounds, diphenylmethane-based compounds, xanthene-based compounds, thiazine-based compounds, spiro compounds, and mixture thereof.

Color formers are dissolved in solvents together with the quinoline derivatives, and the solution is converted into microcapsules, which are coated onto a support. In addition to the color formers and the quinoline derivatives, ultraviolet absorbers may be incorporated in microcapsules if desired. Usable UV absorbers include benzotriazole compounds, benzophenone compounds, salicylic acid compounds, and cyanoacrylate compounds.

Natural or synthetic oils may be used as solvents, either alone or in combination. Illustrative solvents include cottonseed oil, kerosene, paraffin, naphthenic oil, alkylated biphenyls, alkylated terphenyls, chlorinated paraffins, alkylated naphthalenes and diphenyl alkanes. Microcapsules containing color formers may be prepared by various methods, such as a interfacial polymerization method, an internal polymerization method, a phase separation method, an external polymerization method and a coacervation method.

In preparing a coating solution containing microencapsulated color formers, water-soluble binders or latex-based binders are generally used. If desired, cellulose powders, starch particles, and talc may be incorporated in the microcapsule containing coating solution.

The recording sheet of the present invention also employs developers that are capable of reacting with the color formers described above, and illustrative developers include; clay type materials such as acid clay, activated clay, attapulgite, zeolite, bentonite and kaolin; metal salts of aromatic carboxylic acids; and phenolic resins. These developers are coated onto supports such as paper together with binders such as styrene-butadiene latexes. The developers are used in a separate layer on opposite surface to microcapsules or on a layer on a separate sheet.

The following examples are provided for the purpose of further illustrating the present invention but should in no sense be taken as limiting.

EXAMPLES 1 TO 9

A hundred parts of a 4.4% aqueous solution, adjusted to pH 6.0, of a partial sodium salt of poly(vinylbenzenesulfonic acid) (MW: 500,000) were prepared. In this solution, a color former oil prepared by dissolving a color former and quinoline derivative (for names and amounts, see Table 1 below) in 100 parts of diisopropylnaphthalene was dispersed so as to form an o/w (oil-in-water) emulsion having an average particle size of 4.5 μm. In a separate step, a mixture of melamine (6 parts), a 37% aqueous solution of formaldehyde (11 parts) and water (83 parts) was heated to 60° C. with agitation. Thirty minutes later, a transparent aqueous solution containing a mixture of melamine, formaldehyde, and an initial condensation product of melamine and formaldehyde was formed. This solution was added to the previously obtained o/w emulsion. The pH of the mixture was adjusted to 6.0 by addition of a 20% aqueous solution of acetic acid under agitation. Thereafter, the mixture was heated to 65° C. and held at that temperature for 30 minutes so as to complete the formation of microcapsules.

To this solution were added 200 parts of a 20% aqueous solution of polyvinyl alcohol (88% saponified, with the degree of polymerization being 500), 47 parts of starch particles (average size: 15 μm) and 10 parts of talc.

Subsequently, water was added to adjust the solids content to 20%, thereby completing the preparation of a microcapsule-containing solution. This solution was air-knife coated on base paper (40 g/m$^2$) at a coating weight of 5 g/m$^2$ (dry basis) and the web was dried to form a microcapsule-coated sheet.

COMPARATIVE EXAMPLES 1 TO 3

Microcapsule-coated sheets were prepared as in Example 1, except that the color formers used were those indicated in Table 1, and no quinoline derivative was used in the preparation of o/w emulsions.

In order to evaluate the possibility of the development of a blue color on the microcapsule-coated surface and of color staining on a cut surface of the coat, the microcapsule-coated sheets prepared in Examples 1 to 9 and Comparative Examples 1 to 3 were subjected to the following comparative tests.

(1) Development of A Blue Color on the Microcapsule-coated Surface

Spectral absorption curves were taken over the range of 550 nm to 700 nm for the microcapsule coatings in the samples prepared in the Examples and the Comparative Examples and the density (D) at the absorption peak in each curve was measured. Spectral absorption curves were obtained with a color analyzer, Model 307 of Hitachi, Ltd.

(2) Color Staining at Cut Surface of the Microcapsule Coat

A stack of 100 microcapsule-coated sheets was provided for each of the samples prepared in the Examples and Comparative Examples. The stack were guillotined using Sugiyama 72 Standard Cutter and the density of the cut surface of each stack was measured with a Macbeth Reflection Densitometer for any color staining that might have occurred.

The results of the two comparative tests are shown in Table 1.

TABLE 1

| Sample No. | Color former | Quinoline derivative | Development of blue color on coated surface | Color staining of cut surface |
|---|---|---|---|---|
| 1 (invention) | 3,6-bis-diphenylamino- | 2,2,4-trimethyl-1,2- | 0.060 | A |

TABLE 1-continued

| Sample No. | Color former | Quinoline derivative | Development of blue color on coated surface | Color staining of cut surface |
|---|---|---|---|---|
| | fluoran (4.5 parts) | dihydroquinoline (1 part) | | |
| 2 (invention) | 3,6-bis-diphenylamino-fluoran (4.5 parts) | 2,2,4-trimethyl-1,2-dihydroquinoline dimer (1 part) | 0.060 | A |
| 3 (invention) | 3,6-bis-diphenylamino-fluoran (4.5 parts) | 2,2,4-trimetnyl-1,2-dihydroquinoline hexamer (1 part) | 0.061 | A |
| 4 (invention) | 3,6-bis-diphenylamino-fluoran (4.5 parts) | 6-ethoxy-2,2,4-trimethyl-1,2-dihydroquinoline (1 part) | 0.062 | A |
| 5 (invention) | 3,6-bis-diphenylamino-fluoran (4.5 parts) | 6-methoxy-2,2,4-trimethyl-1,2-dihydroquinoline (1 part) | 0.062 | A |
| 6 (invention) | 3,6-bis-diphenylamino-fluoran (4.5 parts) | 6-phenoxy-2,2,4-trimethyl-1,2-dihydroquinoline (1 part) | 0.063 | A |
| 7 (invention) | 3,6-bis-diphenylamino-fluoran (4.5 parts) | 6-benzyloxy-2,2,4-trimethyl-1,2-dihydroquinoline (1 part) | 0.062 | A |
| 8 (invention) | 3,6-bis(N—p-chloro-phenyl)aminofluoran (4.5 parts) | 2,2,4-trimethyl-1,2-dihydroquinoline dimer (1 part) | 0.060 | A |
| 9 (invention) | 3,6-bis(N—phenyl-N—anisyl)aminofluoran (4.5 parts) | 2,2,4-trimethyl-1,2-dihydroquinoline (1 part) | 0.063 | A |
| 1 (comparative) | 3,6-bis-diphenylamino-fluoran (4.5 parts) | None | 0.102 | B |
| 2 (comparative) | 3,6-bis(N—p-chloro-phenyl-N—phenyl)amino-fluoran (4.5 parts) | None | 0.100 | B |
| 3 (comparative) | 3,6-bis(N—phenyl-N—anisyl)aminofluoran (4.5 parts) | None | 0.114 | B |

Note:
A: reduced staining having the density of 0.18 or less and practically useful
B: extensive staining having the density of 0.25 or more and not practicable As Table 1 shows, the development of a blue color on the microcapsule-coated surface and the color staining of the cut surface of the coat that occurred in the microcapsule-coated sheets of the present invention were significantly less than those observed in the comparative samples which did not contain any quinoline derivative in the microcapsule coat.

The present invention therefore provides a microcapsule-coated recording sheet that experiences minimum development of a blue color on the microcapsule-coated surface and which can be cut without causing substantial color staining of the cut surface.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording sheet comprising microcapsules containing a solution which consists essentially of (1) a diarylaminofluoran derivative as a substantially colorless electron donating dye, and (2) a quinoline derivative represented by formula (I)

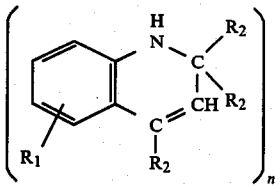

(I)

wherein $R_1$ represents a hydrogen atom, an alkoxy group having from 1 to 8 carbon atoms, an aryloxy group having from 6 to 18 carbon atoms or an aralkyloxy group having from 7 to 18 carbon atoms; $R_2$ represents a hydrogen atom or a methyl group; and n is an integer of 1 to 10, said solution being free of color developers.

2. A recording sheet as in claim 1, wherein $R_1$ represents a hydrogen atom, a methoxy group, an ethoxy group, or a benzyloxy group.

3. A recording sheet as in claim 2, wherein the quinoline derivative of formula (I) is used in an amount ranging from 5 to 200% of the weight of the diarylaminofluoran derivative.

4. A recording sheet as in claim 2, wherein the quinoline derivative of formula (I) is used in an amount of ranging from 10 to 100% of the weight of the diarylaminofluoran derivative.

5. A recording sheet as in claim 2, wherein the diarylaminofluoran derivative is a compound represented by formula (II)

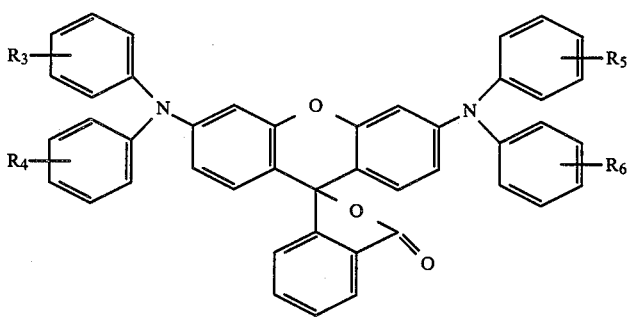

(II)

wherein $R_3$, $R_4$, $R_5$, and $R_6$ each represents a hydrogen atom, an alkyl group, an alkoxy group, or a halogen atom.

6. A recording sheet as in claim 5, wherein the quinoline derivative of formula (I) is used in an amount ranging from 5 to 200% of the weight of the diarylaminofluoran derivative.

7. A recording sheet as in claim 5, wherein the quinoline derivative of formula (I) is used in an amount ranging from 10 to 100% of the weight of the diarylaminofluoran derivative.

8. A recording sheet as in claim 1, wherein the quinoline derivative of formula (I) is used in an amount ranging from 5 to 200% of the weight of the diarylaminofluoran derivative.

9. A recording sheet as in claim 1, wherein the quinoine derivative of formula (I) is used in an amount ranging from 10 to 100% of the weight of the diarylaminofluoran derivative.

10. A recording sheet as in claim 1, wherein the diarylaminofluoran derivative is a compound represented by formula (II)

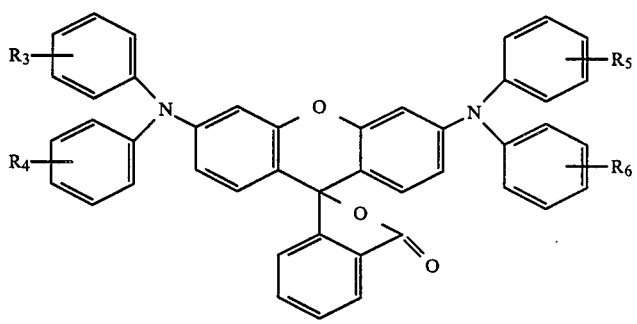

(II)

wherein $R_3$, $R_4$, $R_5$, and $R_6$ each represents a hydrogen atom, an alkyl group, an alkoxy group, or a halogen atom.

11. A recording sheet as in claim 10, wherein the quinoline derivative of formula (I) is used in an amount ranging from 5 to 200% of the weight of the diarylaminofluoran derivative.

12. A recording sheet as in claim 10, wherein the quinoline derivative of formula (I) is used in an amount ranging from 10 to 100% of the weight of the diarylaminofluoran derivative.

13. A recording sheet as in claim 1, wherein the diarylaminofluoran derivative is used in an amount ranging from 0.04 to 0.2 $g/m^2$.

14. A recording sheet as in claim 1, additionally comprising a layer containing an electron accepting compound.

* * * * *